US006142038A

United States Patent [19]

Kenesky et al.

[11] Patent Number: 6,142,038

[45] Date of Patent: Nov. 7, 2000

[54] KNIFE AND BROADHEAD BLADE SHARPENER

[75] Inventors: Theodore Kenesky, 10396 Prouty Rd., Painesville, Ohio 44077; James J. Kenesky, Painesville, Ohio

[73] Assignee: Theodore Kenesky, Painesville, Ohio

[21] Appl. No.: 09/174,112

[22] Filed: Oct. 17, 1998

[51] Int. Cl.[7] ..... B24D 15/08

[52] U.S. Cl. ..... 76/86; 451/524

[58] Field of Search ..... 76/86, 87, 82; 451/523–525

[56] References Cited

U.S. PATENT DOCUMENTS

| | | | |
|---|---|---|---|
| 584,933 | 6/1897 | Friedrich . | |
| 1,255,760 | 2/1918 | Kirlin . | |
| 1,622,197 | 3/1927 | Keezer . | |
| 4,112,790 | 9/1978 | Marder | 76/87 |
| 4,530,188 | 7/1985 | Graves | 51/214 |
| 4,599,919 | 7/1986 | Fortenberry | 76/86 |
| 5,291,805 | 3/1994 | Byers et al. | 76/88 |
| 5,377,563 | 1/1995 | Weeks | 76/86 |
| 5,679,068 | 10/1997 | Byers et al. | 451/557 |

*Primary Examiner*—Douglas D. Watts
*Attorney, Agent, or Firm*—Patrick J. Daugherty

[57] ABSTRACT

A sharpening tool for the sharpening of knives, broadhead arrows and related implements. The sharpener comprises a body with a handle, a handguard, and recesses for detachably mounting rectilinear sharpening elements. The recesses are adapted so that the mounted elements sharpening edges form a "V" shaped cutting angle of a constant degree. This same cutting angle is imparted to a knife edge being sharpened, and accordingly the degree of angle is defined as the optimal blade edge cutting angle. The recesses are further adapted so that the overlapping sharpening elements do not contact each other, preventing the elements from vibrating against each other and thereby extending the useful life of the elements. The point of coincidence of the cutting angle vertex upon the elements occurs substantially spaced from the element edge midpoints, thereby enabling each element edge to provide two distinct sharpening areas when the elements are exchanged and the same element edges are rotated to form the cutting angle. In one embodiment the handguard is adapted to provide planar surfaces for placing the tool upon a table or similar working area while utilizing the tool, and the handguard is further adapted to allow a user to reposition or remove and replace the handguard.

9 Claims, 2 Drawing Sheets

KNIFE AND BROADHEAD BLADE SHARPENER

FIELD OF THE INVENTION

This invention relates generally to the sharpening of cutting edges of tools, such as knives and arrow heads, and more particularly to a hand held sharpening device for such tools.

BACKGROUND INFORMATION

As long as mankind has utilized sharpened devices and cutting instruments such as knives and blades there has been a need for methods and devices for keeping those devices sharp.

Many sharpening devices have been proposed over the years, utilizing a wide variety of sharpening blade shapes and sharpening angles. Some sharpeners utilize round sharpening blades, such as U.S. Pat. No. 4,112,790 to Marder, and U.S. Pat. No. 5,377,563 to Weeks. Due to the radial nature of the sharpening blades these devices do not provide a true "V" shaped edge to the sharpened device, and therefore do not achieve the best shape or durability for the sharpened workpiece.

Other devices rely upon abrasive-type sharpening elements, such as U.S. Pat. No. 4,530,188 to Graves. However, due to the inherently inexact nature of the shape of the sharpening elements, and in particular as extended use wear causes the shape to change, these type of devices also are unable to ensure that the optimal "V" shaped edge results.

Sharpeners have been proposed that utilize beveled metallic sharpening elements, in a variety of shapes. For triangular elements, see U.S. Pat. No. 4,599,919 to Fortenberry, and U.S. Pat. No. 562,223 to Hausse. For square elements, see U.S. Pat. No. 584,933 to Friedrich. While previously proposed devices of this type can obtain the desired "V" shaped edge, they do not precisely position the sharpening elements to provide the best degree of angle to the sharpened edge. And while some allow the sharpening elements to be rotated or exchanged to provide fresh sharpening edges, they do not increase the sharpener element utilization. They also do not increase the useful life of the sharpening elements.

SUMMARY OF THE INVENTION

According to the present invention a sharpening tool is provided which comprises a body with recesses for detachably holding sharpening elements. The recesses are shaped to hold the sharpening elements in a fixed position with respect to each other so that the angle of intersection of the elements is a precise fixed value, thereby ensuring a fixed value for the resultant sharpened workpiece edge shape. Preferably the sharpening elements have sharpening edges which have a point of coincidence with respect to each other located along the sharpening edges between their midpoints and one of their ends, so that exchanging and rotating the detachable elements results in each sharpening edge of each element providing two distinct sharpening points, doubling the useful life of the edges as compared to previously proposed sharpeners. The elements are also spaced so that they do not contact each other while sharpening a work piece; this prevents the elements from vibrating against each other while sharpening a work piece, and therefore prevents vibration related cracking and chipping of the elements. Preferably a removable, adjustable handguard is also provided.

DESCRIPTION OF THE PREFERRED EMBODIMENT(S)

Figure 1:
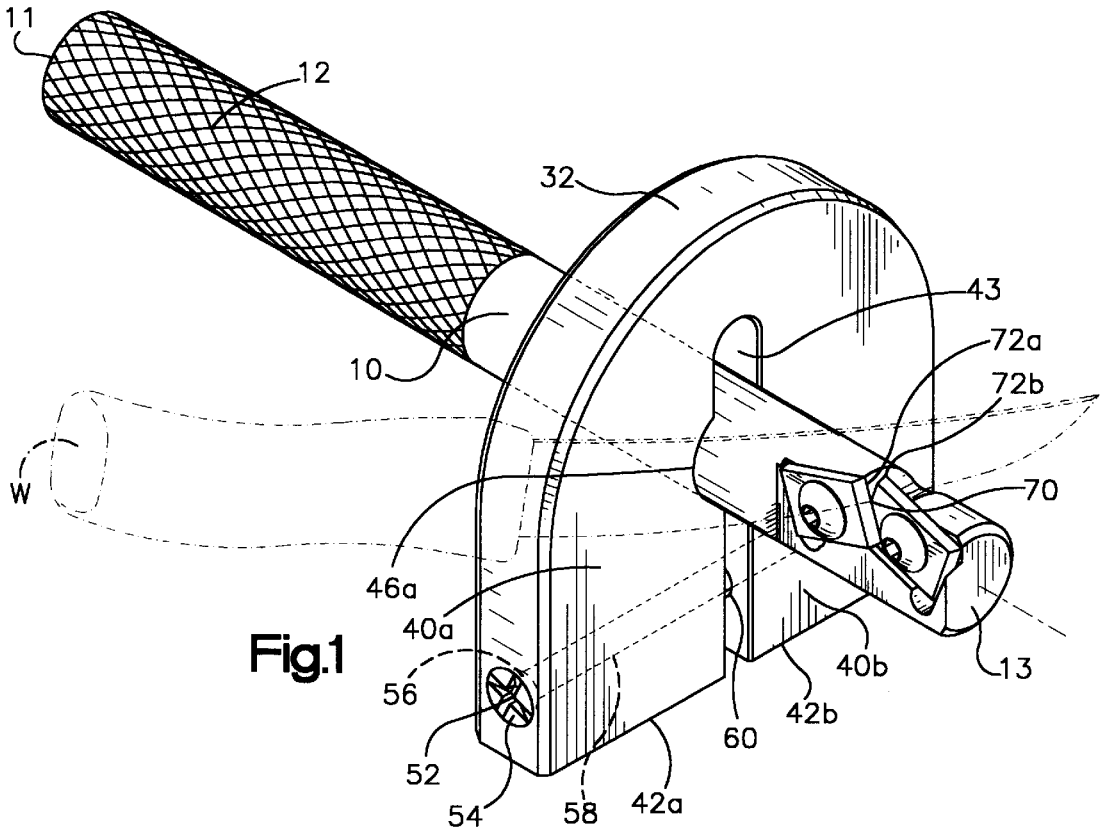
FIG. 1 is a perspective view of one embodiment of a sharpening device according to his invention.
Figure 2:
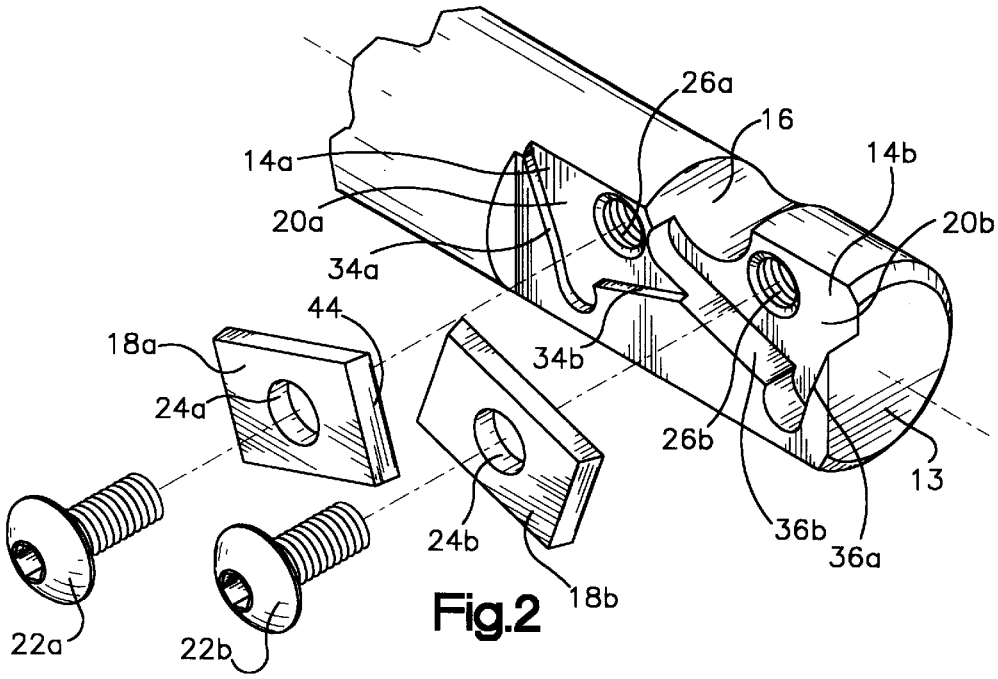
FIG. 2 is an exploded perspective view of the proximal end of the device of FIG. 1.

Referring now to the drawings, and for the present to FIGS. 1 and 2, a sharpening tool is provided which has a unitary cylindrical body 10 with integral handle 12 at a distal end 11, and sharpening element recesses 14*a* and 14*b* at a proximal end 13 for receiving sharpening elements 18*a* and 18*b*. A recess area 16 is also provided at the proximal end for reception of a workpiece W, such as a knife blade. The sharpening elements 18*a* and 18*b* are removably secured against planar mounting surfaces 20*a* and 20*b* respectively in the recesses 14*a* and 14*b* by screws 22*a* and 22*b* passing through holes 24*a* and 24*b* in sharpening elements 18*a* and 18*b* and threaded into threaded apertures 26*a* and 26*b* in the proximal end 13. A handguard 32 is removably positioned on the body 10 between the distal and the proximal ends, the construction of which will be described presently.

The handle 12 is cylindrical in shape, with an outside diameter preferably of about 0.5 inches. It may be securely held in one hand, thereby allowing a single user to utilize the sharpener while that user's other hand manipulates the workpiece to be sharpened. The example depicted in the accompanying drawings uses anodized aluminum for the tool body 10, with the surface of the handle 12 knurled to provide a non-slip grip surface for the user.

Figure 3:
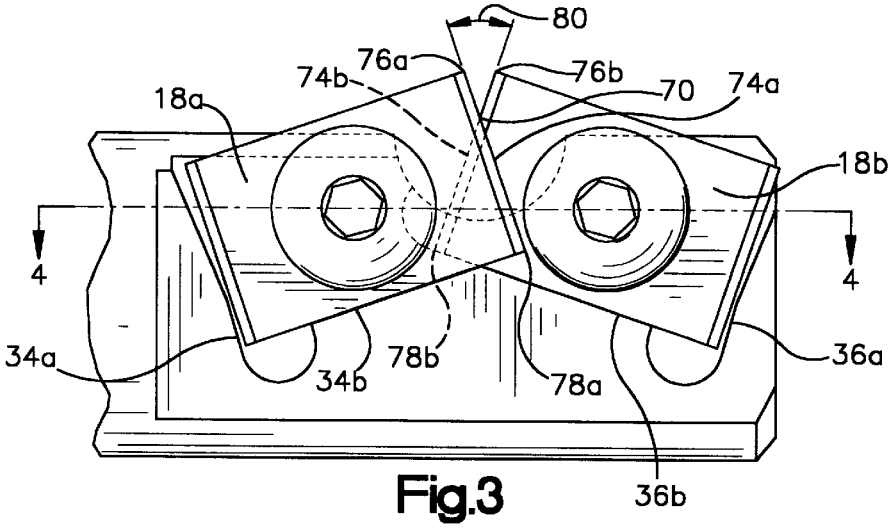
FIG. 3 is a side elevation view of the proximal end of the device of FIG. 1.

Referring now to FIGS. 1, 2 and 3, the points of contact between the workpiece W being sharpened and the sharpening edges 44*a* and 44*b* of sharpening elements 18*a* and 18*b* respectively is a common point of coincidence 70 on cutting edges 72*a* and 72*b* as viewed along the edge of the workpiece W. As shown in FIG. 3, the intersection of the cutting edges 72*a* and 72*b* of sharpening elements 18*a* and 18*b* respectively at the point of coincidence 70 defines a "V"-shaped cutting angle 80. Drawing the workpiece W through the sharpening tool at this point of coincidence 70 with the cutting edges 72*a* and 72*b* as the leading edges causes the cutting edges 72*a* and 72*b* to hone the workpiece by removing material from the workpiece W blade edge. Since the cutting edges 72*a* and 72*b* are linear, the resultant honed edge has a shape substantially equivalent to the cutting angle 80. An important feature of the invention is that the sharpening elements 18*a* and 18*b* secured against the planar mounting surfaces 20 and 20*b* in the recesses 14*a* and 14*b* by screws 22*a* and 22*b* have their rotation about said screws 22*a* and 22*b* constrained by retaining structures 34*a* and 34*b*, and 36*a* and 36*b*, thereby defining the cutting angle 80 as a constant value. In the example depicted in FIG. 3 the structures 34*a* and 34*b* abut against two edges of sharpening element 18*a*, and structures 36*a* and 36*b* abut against two edges of sharpening element 18*b*, thereby precluding rotation of the elements upon their planar mounting surfaces 20*a* and 20*b*. The optimal angle of intersection for sharpening knife and broadhead arrow blade edges is about 19 degrees, although any fixed value within a range of about 19 through about 21 degrees will produce good results. Those skilled in the art may find other values appropriate for their particular applications of this device.

Figure 6:
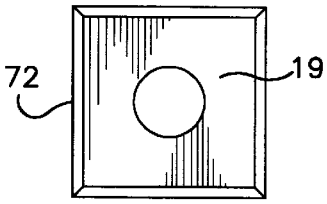
FIG. 6 is a perspective view of another configuration of one of the sharpening elements of this invention.

The two sharpening elements 18*a* and 18*b* are identical in shape and size, and therefore interchangeable. A preferred sharpening element shape is rectilinear, as FIG. 2 illustrates. Another preferred shape is the square sharpening element 19 shown in FIG. 6. A preferred composition of the sharpening elements 18*a* and 18*b* is tungsten carbide. The sharpening edges 44 are beveled surfaces, and the preferred angle of bevel for long life of the beveled edge and optimal workpiece sharpening is a value between about 5 degrees and about 15 degrees, the more preferable value being about 12 degrees.

Figure 4:
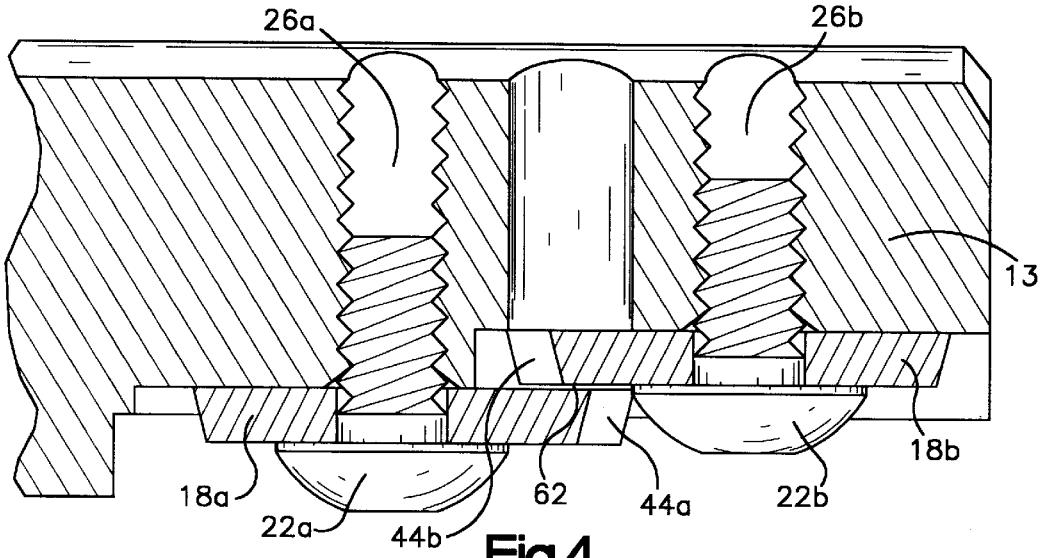
FIG. 4 is a top plan view of the proximal end of the device of FIG. 1.

It is important that the mounted sharpening elements 18*a* and 18*b* do not contact each other while sharpening a workpiece, otherwise vibrations communicated between the two elements while under the tension caused by sharpening the workpiece can cause the elements to prematurely fail by cracking and chipping. As shown in FIG. 4, the mounted first sharpening element 18*a* overlaps but does not touch the mounted second sharpening element 18*b*, these elements being separated by a gap 62. Referring now to FIGS. 2 and 4, this gap 62 is achieved by defining the planar mounting surfaces 20*a* and 20*b* of sharpening element recesses 14*a* and 14*b* respectively as lying on spaced parallel planes, the spacing distance being a value equal to the width of the sharpening elements plus a constant. This constant preferably should be between about 0.003 and about 0.005 inches, and more preferably about 0.003 inches.

Referring now to FIGS. 1 and 3, the point of coincidence 70 is located on the cutting edges 72*a* and 72*b* of sharpening elements 18*a* and 18*b* respectively about midway between cutting edge midpoints 74*a* and 74*b* and cutting edge ends 76*a* and 76*b* respectively. This location enables the user to achieve two points of coincidence 70 on each cutting edge 72 through the following method: by detaching both sharpening elements 18*a* and 18*b*, rotating and reattaching them with their positions on the sharpener exchanged and the same cutting edges 72*a* and 72*b* again intersecting at the point of coincidence 70, the point of coincidence 70 now engages the cutting edges 72*a* and 72*b* at points about midway between their edge midpoints 74*a* and 74*b* and their other respective ends 78*a* and 78*b*. Accordingly, previously unused areas of the same sharpening edges 44*a* and 44*b* will now be used in honing a workpiece. Thus the square sharpening element 19 of FIG. 6 with four sharpening edges 44 provides eight distinct sharpening points of coincidence 70, and the rectilinear sharpening element 18 of FIG. 2 with two sharpening edges 44 provides four sharpening points of coincidence 70.

Figure 5:
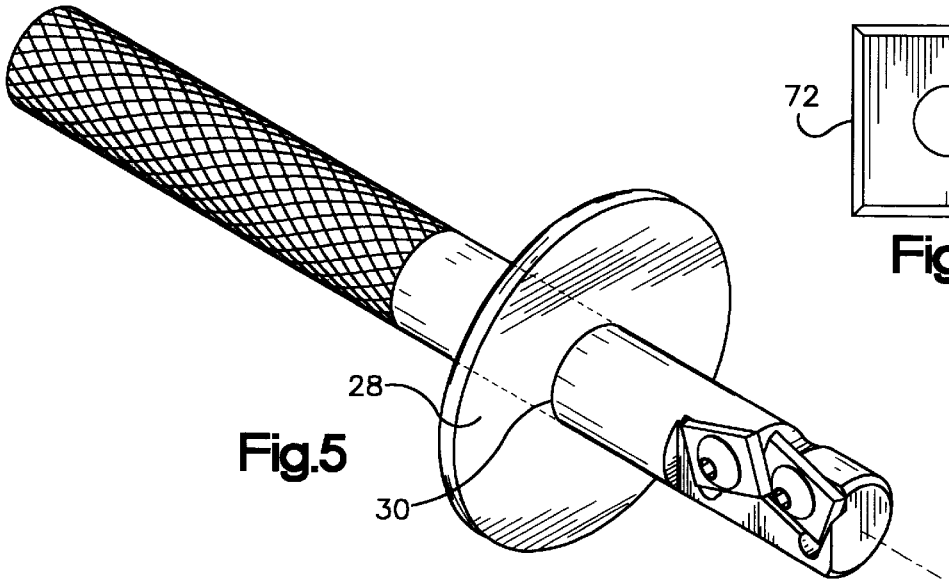
FIG. 5 is a perspective view of another embodiment of a sharpening device according to this invention.

As shown in FIG. 5, the handguard 28 has a circular mounting aperture 30 for the reception of the body 10. It is important that the aperture 30 have an inside diameter value about 0.001 inches less than that of the body 10 outside diameter. With the screws 22*a* and 22*b* and the sharpening elements 18*a* and 18*b* removed from the body 10, the proximal end 13 of the body 10 is inserted into the aperture 30 and the handguard 28 is then press-fit onto the body 10. The handguard 28 is made of a resilient material such as hard plastic. The difference in the inside diameter of the mounting aperture 30 with respect to the body 10 outside diameter causes the resilient handguard 28 material to exert pressure upon the body 10, and this pressure results in a frictional force that resists movement of the mounted handguard 28 with respect to the body 10, thereby keeping the handguard 28 in a fixed position with respect to the body 10. The circular style handguard 28 depicted in FIG. 5 maximizes the portability of the tool, enabling the device to be readily stored in toolboxes, glove compartments, kitchen drawers and the like; it also gives the device a pleasing visual design.

The handguard 32 shown in FIG. 1 is generally arch shaped having a slot 43 defining two legs 40*a* and 40*b* ending in flat planar surfaces 42*a* and 42*b*. The surfaces 42*a* and 42*b* enable the sharpener to be placed firmly upon a work surface, such as a table, kitchen counter or workbench, while a workpiece is being sharpened. Each leg 40*a* and 40*b* also has a semi-cylindrical mounting notch 46*a* and 46*b*. The proximal end 13 of the body 10 is inserted into the slot 43 between the mounting notches 46*a* and 46*b*. The slot 43 is adapted so that the screws 22*a* and 22*b* and the sharpening elements 18*a* and 18*b* freely pass through the slot 43, and therefore need not be removed, as the handguard 32 is slid off of or onto the body 10. The mounting notches 46*a* and 46*b* preferably have a radius value between about 0.001 inches and about 0.005 inches greater than that of the body 10 radius, thereby enabling the body 10 to be freely inserted into or removed from the handguard 32 by hand. This allows a user to reposition, remove or replace the handguard without undue force or special tools, by operating the fastening device described below.

As shown in FIG. 1, a self-tapping #6 flat head sharp point trim screw 52 passes through a cylindrical aperture 58 having a diameter of about 5/32 inch or greater, the slot 43, and engages a cylindrical reception bore 60 having a diameter of about 1/8 inch. The diameter of aperture 58 is larger than the thread diameter of the screw 52, thereby allowing the screw 52 to pass freely through the aperture 58. The threads of self-tapping screw 52 engage the walls of reception bore 60, and thereby cut into the walls of reception bore 60 when the screw 52 is inserted into reception bore 60 with a clockwise rotation. The screw 52 is rotated clockwise and thereby drawn into the bore 60 as the screw threads cut into said bore, until the screw head 54 firmly engages the screw head recess 56. Turning the screw 52 clockwise after the screw head 54 has firmly engaged the screw head recess 56 causes the screw head 54 to force the arch leg 40*a* toward arch leg 40*b*, thereby drawing mounting notch 46*a* towards mounting notch 46*b*, causing said notches to exert pressure upon the body 10. As a result of this pressure, frictional forces between the handle mounting notches 46*a* and 46*b* and the body 10 keep the handguard 32 position fixed with respect to the sharpener body 10. The handguard 32 is made of a resilient material, for example a hard plastic. When screw 52 is turned counterclockwise, the resiliency of the handguard 32 returns the arch legs 40*a* and 40*b* to their normal position with respect to each other, diminishing the pressure of mounting notches 46*a* and 46*b* upon the body 10, thereby reducing the frictional forces holding the handle 29 in a fixed position with respect to body 10, and therefore allowing a user to reposition, remove or replace the handle 29.

While preferred embodiments of the invention has been described herein, variations in the design may be made, and such variations may be apparent to those skilled in the art of making tools, as well as to those skilled in other arts. The materials identified above are by no means the only materials suitable for the manufacture of the tool, and substitute materials will be readily apparent to one skilled in the art. The scope of the invention, therefore, is only to be limited by the following claims.

What is claimed is:

1. A sharpening tool, comprising:

a) an elongated body having a front end and a handle end, said front end further comprising a top area for insertion of a workpiece blade for sharpening;

b) said front end including first and second planar mounting surfaces for mounting sharpening elements, said first and second planar mounting surfaces lying on spaced parallel planes;

c) said front end further including at least one sharpening element retaining structure associated with each of said first and second planar mounting surfaces;

d) first and second sharpening members, each having at least one sharpening edge and a planar mounting face, said sharpening edges each further having a midpoint and first and second ends, each of said midpoints dividing the edge into two edge halves, said first and second sharpening members each further having a thickness less than the distance between said spaced parallel planes;

e) at least one fastening device detachably mounting said first and second sharpening members to said front end with the planar mounting face of each sharpening member in contact with the respective mounting surface on the front end and the sharpening elements also in contact with the respective retaining structures, and with at least one first sharpening member sharpening edge overlapping and spaced from at least one second sharpening member sharpening edge; and f) a cutting angle formed by said overlapping sharpening edges within said front end top area for sharpening a workpiece blade, said cutting angle having a bottom vertex and two top endpoints, wherein said bottom vertex is formed by sharpening member sharpening edges to engage and sharpen a workpiece blade drawn through it, and said top endpoints are the sharpening edge ends which define said cutting angle and are located above said bottom vertex;

g) wherein said cutting angle is a fixed value, said value held constant by the sharpening member retaining structures, which constrain movement of the sharpening members relative to each other; and h) wherein said cutting angle vertex is located at a point along each sharpening edge about midway between said edge midpoints and said top endpoints, and therefore within the one-half of each sharpening edge positioned toward the top of the front end top area.

2. The sharpener of claim 1 wherein the cutting angle has a vertex and the sharpening edges each have a midpoint and first and second ends, said cutting angle vertex being located at a point along each sharpening edge about midway between said edge midpoint and one of said first and second ends.

3. The sharpener of claim 1 further comprising a handguard attached to the body.

4. The sharpener of claim 3 wherein said handguard member further comprises a planar mounting surface for placement upon a work surface, and a tightening device for tightening the handguard about the sharpener body.

5. The sharpener of claim 1 wherein the first and second sharpening members are identical in size and shape.

6. The sharpener of claim 1 wherein the first and second sharpening members are shaped as squares with four equal sharpening edges.

7. The sharpener of claim 1 wherein the beveled sharpening edges have a surface angle of bevel between about 5 and about 15 degrees.

8. A sharpening tool comprising:

a body member having a front end and a handle end, a handguard member carried by the body member between the front and handle ends, the front end further defining a top recessed area for receiving and sharpening a workpiece blade drawn through said area, bounded by first and second planar mounting surfaces and a multiplicity of edge walls, said planar walls lying in parallel planes with respect to each other, at least one fastening device for detachably mounting sharpening members to said front end top recessed area, first and second sharpening members fastened against said first and second planar mounting surfaces and edge walls by at least one said fastening device such that the sharpening members lie in parallel and overlapping planes, said sharpening members not in contact with a multiplicity of linear beveled sharpening edges located on said sharpening members, said edges having a midpoint and first and second ends, said midpoint dividing the edge into two edge havles, and a top sharpening angle of coincidence having a vertex for receiving and sharpening a workpiece blade drawn through said anble, said angle formed by one first sharpening member beveled edge and one second sharpening member beveled edge within said front end top recessed area, said angle further defined in a plane parallel to the planar mounting surface planes, the vertex being spaced from the midpoints of the veveled sharpening edges and located along each sharpening edge between said edge midpoints and the edge ends located at the topmost of said front end top recessed area, and therefore within the within the one-half of each sharpening edge positioned toward the top of the front end top recessed area, and wherein said top sharpening angle is a fixed value, said value held constant by the planar mounting surfaces and the multiplicity of edge walls, which constrain movement of the sharpening members relative to each other.

9. A sharpening tool comprising:

a body member having a front end and a distal end, a handguard member carried by the body member between the front and distal ends, the front end further defining a recessed area bounded by first and second planar mounting surfaces and a multiplicity of edge walls, said planar walls lying in parallel planes with respect to each other, a fastening device for detachably mounting sharpening members to said front end recessed area, first and second sharpening members fastened against said first and second planar mounting surfaces and edge walls by said fastening device such that the sharpening members lie in parallel and overlapping planes, said sharpening members not in contact with each other, a multiplicity of linear beveled sharpening edges located on said sharpening members, said edges having a midpoint and first and second ends, a sharpening angle of coincidence having a vertex, said angle formed by one first sharpening member beveled edge and one second sharpening member beveled edge, said angle further defined in a plane parallel to the planar mounting surface planes, the vertex being spaced from the midpoints of the beveled sharpening edges.

* * * * *